United States Patent [19]

Boles

[11] Patent Number: 4,673,140

[45] Date of Patent: Jun. 16, 1987

[54] METHOD AND APPARATUS FOR FACILITATING THE WITHDRAWAL OF STRAND FROM WOUND PACKAGES

[75] Inventor: David M. Boles, Anderson, S.C.

[73] Assignee: Owens-Corning Fiberglas Corporation, Toledo, Ohio

[21] Appl. No.: 908,844

[22] Filed: Sep. 18, 1986

[51] Int. Cl.[4] ..... B65H 49/02

[52] U.S. Cl. ..... 242/54 R; 242/128; 242/130; 242/131; 242/159; 242/170; 242/172

[58] Field of Search ..... 242/130, 131, 131.1, 242/129.5, 129.7, 134, 137, 137.1, 138, 139, 141, 146, 54 R, 128, 159, 163, 170, 171, 172, 173

[56] References Cited

U.S. PATENT DOCUMENTS

| | | | |
|---|---|---|---|
| 2,716,008 | 8/1955 | Taylor, Jr. | 242/163 |
| 2,736,512 | 2/1956 | Drummond et al. | 242/170 |
| 3,601,326 | 8/1971 | Gordon | 242/163 X |
| 3,746,276 | 7/1973 | Stotler | 242/171 X |
| 3,983,997 | 10/1976 | Warshaw | 242/173 X |
| 4,067,441 | 1/1978 | Newman et al. | 242/163 X |
| 4,300,734 | 11/1981 | Green et al. | 242/170 |
| 4,460,086 | 7/1984 | Davis | 242/172 X |

*Primary Examiner*—Stanley N. Gilreath

*Attorney, Agent, or Firm*—Ronald C. Hudgens; Ronald E. Champion; Greg Dziegielewski

[57] ABSTRACT

The present invention pertains to method and apparatus for facilitating the withdrawal of strand from the interior of a wound package a strand comprising biasing a movable manifold means against a portion of the arcuate periphery of the package, the manifold means having an apertured section in contact with the package; and drawing a vacuum in the manifold means effective to retain the strands at the periphery of the package until withdrawn to facilitate the complete withdrawal of the strand from the package.

11 Claims, 3 Drawing Figures

METHOD AND APPARATUS FOR FACILITATING THE WITHDRAWAL OF STRAND FROM WOUND PACKAGES

TECHNICAL FIELD

The invention disclosed herein relates to method and apparatus for withdrawing strand from the inside of an helically wound package of strand wherein a movable, vacuum assisted manifold means is biased against a portion of the periphery of the package to retain the strands at the periphery of the package to facilitate the complete withdrawal of the strand from the package.

BACKGROUND ART

There are many ways to collect strand; one of which is to helically wind the strand into a package. Basically, there are two ways to lineally withdraw the strand from such packages. Either the strand is unwound from the exterior of the package or the strand is withdrawn from the interior of the package.

When the strand is withdrawn from the interior of the package, there is a tendency for the last few remaining wraps of strand at the outer periphery of the package to collapse and snarl, thus disrupting or stopping the withdrawal process.

The present invention provides method and apparatus for simply and effectively controlling or retaining the strands at the arcuate periphery of the package to permit complete withdrawal of the strand from the interior of the package.

DISCLOSURE OF THE INVENTION

The present invention pertains to method and apparatus for withdrawing strand from the interior of a wound package a strand comprising biasing a movable manifold means against a portion of the arcuate periphery of the package, the manifold means having an apertured section at the region of contact with the package; and drawing a vacuum in the manifold means effective to retain the strands at the periphery of the package until withdrawn to facilitate the complete withdrawal of the strand from the package.

BEST MODE OF CARRYING OUT THE INVENTION

Figure 1:
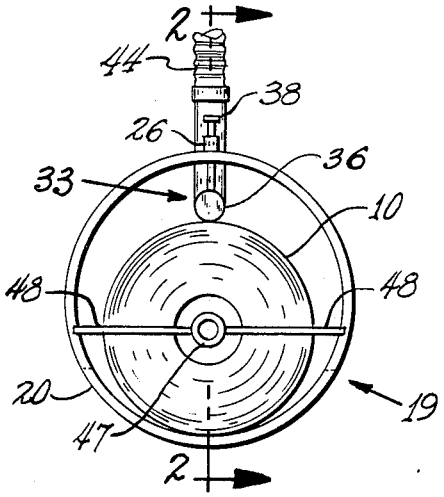
FIG. 1 is a front elevational view of the strand withdrawal assist device according to the principles of this invention.
Figure 2:
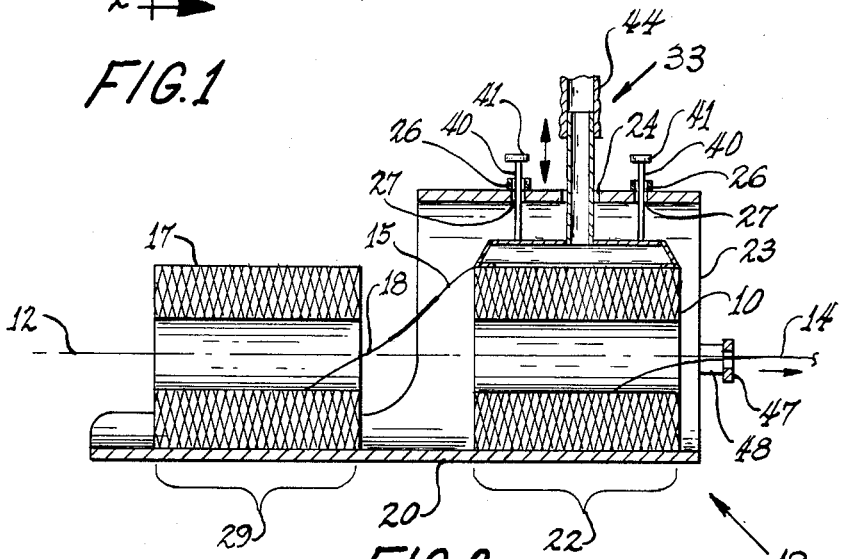
FIG. 2 is a sectional side view of the apparatus shown in FIG. 1 taken along view 2.2.

According to the principles of this invention, strand control device 19 is comprised of a base member 20 and a manifold means 33 which is movable with respect to base member 20. As shown in FIG. 1, a first package of helically wound strand 10 is cradled within the generally circular discharge section 22 of base member 20. As shown, the axis 12 of the first package of strand 10 is generally horizontal. However, it has been found to be desirable to orient axis 12 of package 10 such that the front of the package, that is the portion of the package closest to front 23 of base member 20 is slightly higher than the rear of the package. Desirably, axis 12 of package 10 is angled within the range from about 3 degrees to about 7 degrees from true horizontal. As such, the axis 12 of the package is still substantially horizontal, but it has been found that if a loop of strand in the package should prematurely fall, it is preferable that the top of the loop will fall toward the rear of the package as opposed to falling forward. Such a slight upward inclination of the system is effective in further reducing snarls in the strand notwithstanding the fact that from time to time loops will prematurely disengage from the package along its interior cavity.

Movable manifold means 33 is biased against the arcuate periphery 11 of package 10. As shown, manifold means 33 is positioned above package 10 such that gravity biases manifold means 33 against package 10. However, it is to be understood that manifold means 33 may be biased by any other suitable means such as springs and the like, if desired.

Biasing manifold means 33 against the arcuate periphery of the package permits the manifold to (1) adapt to packages of different diameters and (2) adapt or conform to the package periphery as the package means completion of pay-out. Near payout, some packages have a tendency to slightly compress or sag. The present invention compensates for such in process package deformations.

Figure 3:
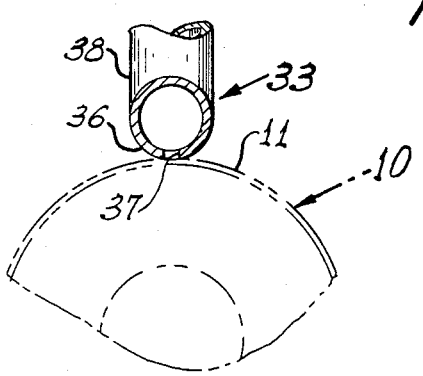
FIG. 3 is an enlarged view of a portion of the frontal view shown in FIG. 1.

Manifold means 33 is comprised of a tubular chamber 36 which desirably has a length coextensive with the length of the packages to be unwound. As can be seen FIG. 3, tubular chamber 36 has a narrow apertured section or slot 37 at the region of contact between tubular chamber 36 and the arcuate periphery 11 of package 10. When a vacuum is drawn within tubular chamber 36, the outer layers of strand along the arcuate periphery of 11, package 10 are retained or held against tubular chamber 36 to facilitate the complete withdrawal of the stand 14 from the package 10.

Any suitable system may be employed for establishing a vacuum within tubular chamber 36. As shown, conduit 38 extends transversly, upwardly from tubular chamber 36. Conduit 38 is joined to a flexible duct 44 which is connected to a suitable source of vacuum (not shown).

Manifold means 33 may be positioned by an suitable means. As shown, conduit 38 extends through recess 24 in discharge section 22 of base member 20. Further, guide pins 40, which are located fore and aft of conduit 38 on tubular chamber 36 are positioned in bores 27 of guide sleeves 26 on discharge section 22. As such, slot 37 of tubular chamber 36 is oriented substantially parallel to the axis 12 of package 10, and tubular chamber 36 is permitted to rest against the periphery 11 of package 10 during withdrawal. Positive stops 41 on guide pins 40 prevent manifold means 33 from dropping to far into the interior or discharge section 22 as the last wraps or layers of strands are withdrawn from package 10.

To provide a continuous supply of strand 14 to whatever further processing is desired, base member 20 also includes a standby or reserve section 29 extending rearwardly from discharge section 23. Reserve section 29 cradles or supports a second package of strand 17. Conveniently, second package 17 is positioned substantially coaxial with first package 10 on base member 20. Such packages are spliced by joining the lead strand 18 from the interior of second package 17 with the tail strand 15 from the exterior of the first package 10 to establish a continuous supply of strand. After the first package 10 pays out, the second package of strand 17 is merely slid from the reserve section 29 into the discharge section 22 under manifold means 33, while the strand continues to be withdrawn, if desired. Whereupon, yet another package of strand may be placed in the reserve section 29, and the tail and lead of the packages are spliced to provide a continuous supply of strand.

As shown, the discharging strand 14 is positioned within strand guide 47 near the front 23 of discharge section 22. Conveniently, strand guide 47 is supported by a pair of rods 48 suitably attached to discharge section 22.

As shown, slot 37 of tubular chamber 36 is configured to contact only a very small minority of the arcuate periphery 11 of package 10. For packages having an outer diameter of approximately 12 inches, slot 37 may only have a width of about 1/4 inch. It is to be understood, however, that apertured sections may contact much more, but preferably still a minority, of the arcuate periphery of the packages as desired.

It is apparent that within the scope of the present invention, modifications and different arrangements can be made other than as herein disclosed. The present disclosure is merely illustrative with the invention comprehending all variations thereof.

INDUSTRIAL APPLICABILITY

The invention disclosed herein is readily applicable to the textile industry, and in particular, the textile glass fiber industry.

What is claimed is:

1. Apparatus of holding a package of strand helically wound about an axis so that the strand can be unwound, from the interior thereof, said package having an arcuate periphery, comprising;

base member adapted to support at least one package of strand; and manifold means movable with respect to the base member and biasable against a portion of the arcuate periphery of the package, the manifold having an apertured section at the region of contact with the package, the manifold being adapted to be connected to a source of vacuum to cause the outer periphery of the package to be drawn against the apertured section of the manifold during withdrawl of the strand from the package to retain the strands at the periphery of the package of facilitate the complete withdrawal of the strand from the package.

2. The apparatus of claim 1 wherein the base member is adapted to orient the axis of the packages substantially horizontally.

3. The apparatus of claim 2 wherein the manifold means is positioned above the package to permit gravity to bias the manifold against the periphery of the package.

4. The apparatus of claim 2 wherein the base section is capable of holding at least 2 packages oriented substantially horizontially along a common axis.

5. The apparatus of claim 3 further comprising a guide means positioned at an end of the base section through which the strand passes as the strand is withdrawn from the package.

6. The apparatus of claim 2 wherein the manifold means is configured to contact a minority of the arcuate periphery of the package.

7. The apparatus of claim 2 wherein the base member is adapted to orient the axis of the package such that the front of the package is slightly higher than the rear.

8. The apparatus of claim 7 wherein the axis of the package is inclinded about 3 to about 7 degrees from horizontal.

9. A method of withdrawing strand from the inside of a wound package of strand comprising:

orienting the axis of the package generally horizontally;

biasing a movable manifold means against a portion of the arcuate periphery of the package, the manifold means having an apertured section in contact with the package; and drawing a vacuum in the manifold means effective to retain the strand at the periphery of the package until withdrawn to facilitate the complete withdrawal of the strand from the package,

10. The method of claim 9 wherein the manifold means is positioned above the package.

11. The method of claim 10 further comprising staging a second package of strand coaxial with the first package and joining the strand from the interior of the second package to the strand from the exterior of the first package to establish a continuous supply of strand.

* * * * *